US005802776A

United States Patent [19]

Murray

[11] Patent Number: 5,802,776

[45] Date of Patent: Sep. 8, 1998

[54] GUTTER TRAP ASSEMBLAGE

[76] Inventor: Joseph A. Murray, 116 Smoke Rise Dr., Warren, N.J. 07059-6821

[21] Appl. No.: 831,049

[22] Filed: Apr. 1, 1997

Related U.S. Application Data

[63] Continuation-in-part of Ser. No. 608,687, Feb. 29, 1996, abandoned.

[51] Int. Cl.[6] ..... E04D 13/00

[52] U.S. Cl. ..... 52/12; 52/16

[58] Field of Search ..... 52/12–16

[56] References Cited

U.S. PATENT DOCUMENTS

| | | | |
|---|---|---|---|
| 316,578 | 4/1885 | Schumann et al. . | |
| 1,862,134 | 6/1932 | Boosey | 52/12 X |
| 4,272,370 | 6/1981 | Cunning | 52/12 X |
| 4,951,430 | 8/1990 | Gottlieb | 52/16 X |
| 5,107,635 | 4/1992 | Carpenter | 52/16 X |
| 5,170,596 | 12/1992 | Zadok et al. | 52/16 |

*Primary Examiner*—Christopher Kent
*Assistant Examiner*—Yvonne Horton-Richardson
*Attorney, Agent, or Firm*—Salvatore C. Mitri

[57] ABSTRACT

There is disclosed a gutter trap assemblage which is adapted for use with conventional, U-shaped gutters and their downspouts. The gutter trap assemblage is an integral, one piece unit having an upper section and a lower section. When installed, the upper section mates with and communicates with a conventional U-shaped gutter and the lower section communicates with a conventional gutter downspout. The upper section also communicates with the lower section through its open bottom which is co-extensive with the open top of the lower section. A plurality of screens are provided in the lower section to form a series of chambers therein. The screens are positioned so that their top edges are below the plane of the bottom wall of a conventional, U-shaped gutter. Since water seeks its own level, this permits a maximum flow of water to be maintained in the conventional, U-shaped gutter and the gutter trap assemblage since leaves, seeds and other debris are deposited into and trapped within the screened chambers of the lower section before they can reach the gutter downspout. Because of this self-cleaning action in the conventional, U-shaped gutter, only the gutter trap assemblage of the invention needs to be cleaned of accumulated leaves, seeds and other debris.

4 Claims, 4 Drawing Sheets

GUTTER TRAP ASSEMBLAGE

This application is a continuation-in-part application of copending application Ser. No. 08/608,687 filed Feb. 29, 1996.

FIELD OF THE INVENTION

This invention is directed toward a unique gutter trap assemblage which is adapted for use with conventional, U-shaped gutters and their downspouts. The assemblage of the invention prevents clogging of the gutter system and significantly reduces the number of times one must climb a ladder in order to remove leaves and other debris that normally accumulate in conventional, U-shaped gutters.

Conventional U-shaped gutters typically have a front wall; an opposed, spaced-apart rear wall; a bottom wall connecting the front and rear walls; and an open top thereby forming a U-shaped configuration. These gutters are basically channels that are installed at the eaves of roofs for collecting and carrying off rainwater to connecting gutter downspouts which direct the water away from building foundations. This is efficiently accomplished as long as the gutters, when installed, are the proper size and have the correct pitch. Frequently, the gutters and the gutter downspout screens have to be cleared of leaves and other debris that interfere with the adequate flow of water along the gutter and into the gutter downspout. Unfortunately, this condition may not last long because leaves, seeds and other debris are sporadically falling all the time. This condition is especially accelerated during periods of drought and dry spells when the roots of trees do not receive sufficient amounts of water and, therefore, attempt to conserve the water that is available by shedding those leaves that are farthest away from their bases and trunks. Many of these leaves end up on roofs and in gutters and, when it is windy, rainy or stormy, they will fall and accumulate at a much faster rate. In addition, during the spring and fall seasons of the year, significant amounts of seeds, leaves and other debris can also be blown onto roofs and into gutters.

As leaves and other debris accumulate in a clean gutter, they are swept along with rainwater and deposited at or near the gutter downspout screen. The purpose of the gutter downspout screen, which is removable for cleaning, is to prevent leaves and other debris from entering and clogging the gutter downspout. However, as leaves and other debris accumulate at or near the gutter downspout screen, the flow of rainwater in the gutter starts to decrease. Further accumulations will reduce the flow of water even more resulting in a back-up and settling of the leaves and other debris at the bottom of the gutter, starting first at the gutter downspout screen and eventually backing up into the entire length of the gutter. Over a period of time, the accumulation of leaves and other debris at or near the gutter downspout screen will restrict and eventually completely block the passage of rainwater to and into the gutter downspout causing the gutters to overflow.

Due to the manner in which conventional, U-shaped gutters are presently designed, the presence of only a few leaves of average size in a clean gutter carried along by the flow of water can result in partially obstructing the gutter downspout screen and cause a decrease in the flow of water in the gutter to and through the gutter downspout screen and the gutter downspout. This occurs because as water flows in a gutter, it carries along with it seeds, leaves and other debris in the gutter to the gutter downspout screen. As water flows through the gutter downspout screen, these seeds, leaves and other debris are prevented from passing through the screen and thus begin to block and cover the surface of the gutter downspout screen. Water will then seek to flow through that part of the gutter downspout screen that is still clear or open. However, upon the further accumulation of seeds, leaves and other debris, this process will be repeated again and again until the entire surface of the gutter downspout screen is covered and blocked. Due to the continued flow of water in the gutter, seeds, leaves and other debris will continue to be carried by the water and deposited in any area where water can still pass through these seeds, leaves and other debris to and through the gutter downspout screen and into the gutter downspout. Because of the continued flow of water in the gutter, a self-sealing process takes place that will eventually completely seal and block the gutter downspout screen with the accumulated seeds, leaves and other debris. During a drought or dry spell, these accumulated seeds, leaves and other debris will dry and harden resulting in a more permanent sealing or closure of the gutter downspout screen.

Even when there is not much accumulation and under certain conditions, such as a sudden rainfall, there may be a strong sweeping action within the gutters causing a damming effect when leaves and other debris are deposited at or near the gutter downspout screen resulting in its partial or complete blockage thereby causing the rainwater to back up and possibly overflow the gutters. Such an overflow could result in damage to the roof, fascia and soffet. If this occurs during the winter, the accumulation of water in the gutter could freeze causing those gutters equipped with couplings to open and leak. An overflow could also result in the formation of ice underneath the roofing material, inside the fascia and on top of the soffet. In addition, an overflow could result in water working its way to the inside of the outside wall of a building possibly causing damage to wood, insulation, ceilings and inside walls. Such overflow water could potentially work its way into electrical outlet boxes creating a condition for causing short circuits and/or fire in an inside wall or a ceiling which would not be immediately noticed.

In any event, the gutters would have to be cleaned. In most cases, this requires climbing up and down a ladder which typically has to be periodically moved along the entire length of the gutters in order for them to be properly cleaned. Movement of the ladder along the outside of a building that has foundation plantings could result in possible damage to shrubbery, flowerbeds, and the like and may also interfere with the safe and proper placement of the ladder, especially where the grade of the land surrounding the building structure is not level. Each repositioning of the ladder requires one to climb up and down which is a hazardous, tiring, time-consuming exercise and which could be expensive if someone has to be hired to do this work.

In addition, buildings with other types of roofs attached such as lean-to, hip, gable, and the like, where adjacent roofs may be of different heights and different pitches, one would be required to climb onto a lower roof to clean out a conventional, U-shaped gutter on an adjacent, higher roof. Because of the pitch of a roof, a climbing/walking action would be required along its entire length to clean out the conventional, U-shaped gutter on the higher roof. In some cases, the gutter to be cleaned is of such a height that a ladder and a leveling platform would be needed. Under these circumstances, damage could be done to the roofing material of the lower roof by the climbing/walking action and/or the movement of the ladder and the leveling platform in addition to placing on the roof all of the equipment needed to clean out the gutter such as buckets, scrapers, garden hoses, etc.

Additional damage could also occur if the cleaning is done in cold weather when the roofing material is hard and brittle or in hot weather when the roofing material is soft resulting in cracking, stretching or breaking the roofing material.

SUMMARY OF THE INVENTION

It has now been found that by using the gutter trap assemblage of the invention with conventional, U-shaped gutters the problems and risks associated with cleaning out and maintaining conventional gutters free from accumulated leaves and other debris are significantly and substantially reduced and minimized.

The purpose of the gutter trap assemblage of the invention is to maintain a maximum flow of water in a gutter to and through the gutter downspout screen and into the gutter downspout by removing seeds, leaves and other debris from a gutter and trapping them before they can be deposited at or near the gutter downspout screen.

The gutter trap assemblage of the invention is intended to be installed as a replacement unit for a section of a conventional, U-shaped gutter that is removed where it connects to and communicates with a gutter downspout. With the gutter trap assemblage of the invention properly installed in association with a conventional, U-shaped gutter, only the gutter trap assemblage needs to be cleaned out so that one has to climb a ladder only once where the gutter trap assemblages are located.

The gutter trap assemblage of the invention is an integral, one-piece unit and generally comprises: an upper section having a front wall; a rear wall spaced from said front wall; opposed, spaced apart sides; and, an open top and an open bottom defined between said front and rear walls and said opposed, spaced apart sides; a lower section having a front wall; a rear wall spaced from said front wall; opposed, spaced apart end walls; a bottom wall interconnecting said front wall, said rear wall and said end walls collectively defining an open top therebetween, said defined open top being co-extensive with said open bottom of said upper section enabling communication between said upper section and said lower section through said open bottom of said upper section and said defined open top of said lower section; and, means to secure said assemblage to a conventional gutter with said open bottom of said upper section and said open top of said lower section aligned to be on the same plane as the bottom wall of a conventional, U-shaped gutter such that said assemblage communicates with said conventional, U-shaped gutter through said spaced apart sides of said upper section.

In one embodiment, a tubular gutter downspout screen is provided to extend upwardly from a conventional gutter downspout through the lower and upper sections of the gutter trap assemblage so that the upper end of the tubular gutter downspout screen is at least on the same plane as the upper edges of the front and rear walls of the upper section.

In another embodiment, the gutter trap assemblage includes a plurality of vertically disposed, spaced apart screen members which can be removably secured within the lower section by conventional means. These screen members define a plurality of chambers within the lower section and should be of a size such that their upper ends are slightly below the common plane defined by the open top of the lower section and the bottom wall of the conventional, U-shaped gutter.

Removably securing the screen members within the lower section facilitates cleaning of the gutter trap assemblage which can be accomplished either by removing all of the screen members and cleaning the entire length of the lower section or sequentially cleaning each chamber and sequentially removing each screen member as successive chambers are cleaned.

The gutter trap assemblage of the invention can be installed to mate with a conventional, U-shaped gutter by using typical means such as, for example, circumferential straps that encircle the gutter trap assemblage.

The gutter trap assemblage of the invention is manufactured as an integral one-piece unit from materials typically employed in the manufacture of conventional gutters such as, for example, aluminum, vinyl coated aluminum, plastics, and the like. When installed as a replacement unit, that portion of a conventional, U-shaped gutter that leads to a conventional gutter downspout is removed and the gutter trap assemblage of the invention is installed in its place secured adjacent the eave of the roof so that the opposed sides of the upper section mate with and communicate with the conventional, U-shaped gutter and the lower section communicates with the gutter downspout.

Since many conventional , U-shaped gutters have different cross-sectional configurations such as curvilinear front walls and straight or vertical rear walls, the front and rear walls of the upper section of the gutter trap assemblage of the invention can be fabricated so that these walls correspond with the contours of the conventional, U-shaped gutter with which it is to be used. Thus, when that section of a conventional, U-shaped gutter that communicates with a gutter downspout is removed and replaced with the gutter trap assemblage of the invention, a mating match can be achieved.

BRIEF DESCRIPTION OF THE DRAWING

The gutter trap assemblage of the invention will become more apparent from the ensuing description when considered together with the accompanying drawing which illustrates preferred embodiments thereof and wherein.

DETAILED DESCRIPTION OF THE DRAWING AND THE INVENTION

Figure 1:
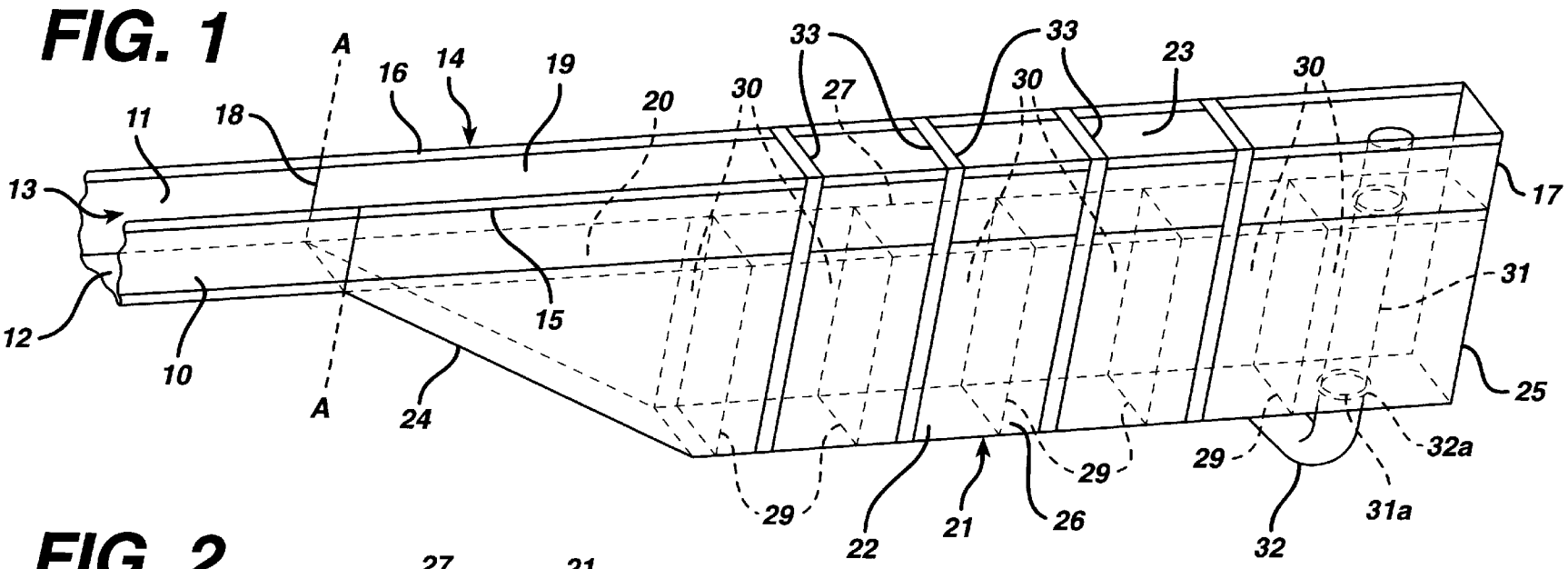
FIG. 1 is a perspective view of one embodiment of the gutter trap assemblage of the invention.

In the drawing, wherein like reference numerals denote like parts, there are illustrated several embodiments of the gutter trap assemblage of the invention which is intended for use with conventional, U-shaped gutters. In FIGS. 1 and 3–6 of the drawing, that point at which the gutter trap assemblage of the invention is connected to a conventional, U-shaped gutter is indicated by the broken line A—A and always includes the gutter downspout. As can be seen in these Figs., a conventional, U-shaped gutter is typically fabricated to have a front wall 10, a rear wall 11 spaced from the front wall 10, and a bottom wall 12 interconnecting the front and rear walls 10 and 11 to define a U-shaped channel 13 therebetween.

Figure 3:
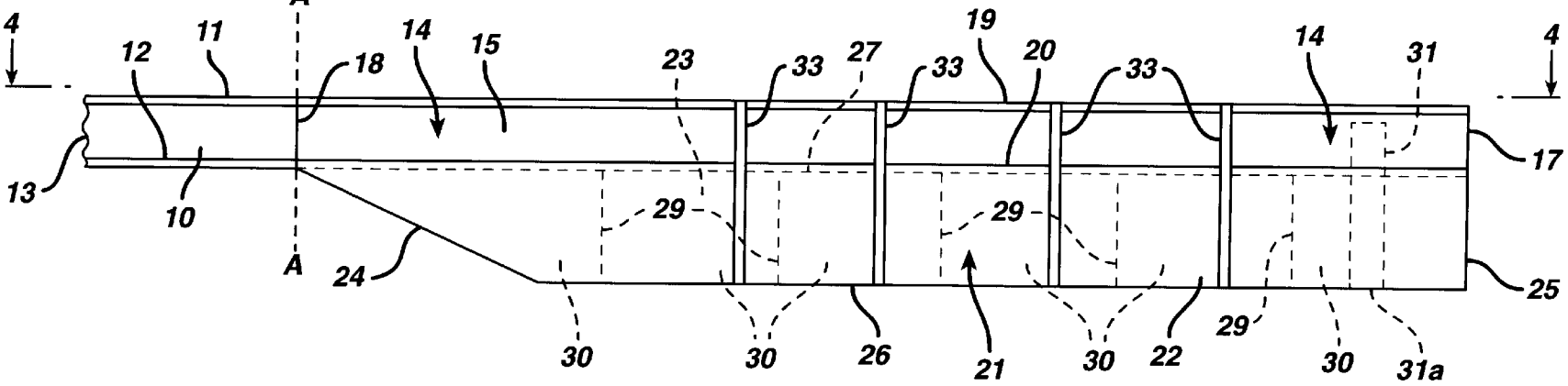
FIG. 3 is a side elevation view of the gutter trap assemblage shown in FIG. 1.
Figure 4:
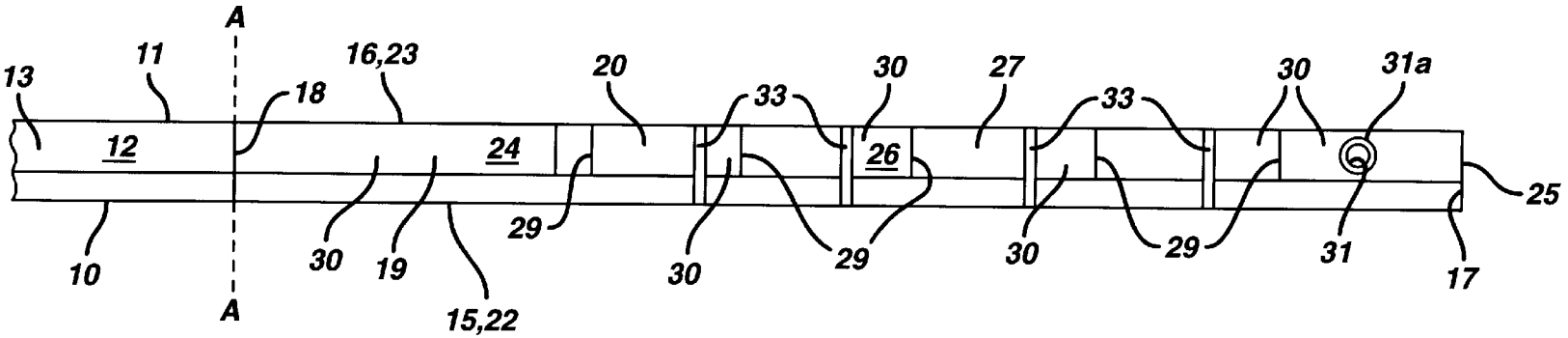
FIG. 4 is a top view of the gutter trap assemblage taken substantially on the line 4—4 of FIG. 3.

With reference to FIGS. 1, 3 and 4, it can be seen that the gutter trap assemblage of the invention intended to be installed on leanto or gabled type roofs comprises an upper section identified by reference numeral 14, having a front wall 15, a rear wall 16 spaced from the front wall and opposed, spaced apart sides 17 and 18 defining an open top 19 and an open bottom 20 therebetween. In the embodiment shown in FIGS. 1, 3 and 4, that side of upper section 14 that would be positioned adjacent a gutter downspout is closed; i.e., side 17, while the side opposite and spaced from closed side 17 is open; i.e., side 18, so that when this embodiment of the gutter trap assemblage is installed, side 18 mates with and communicates with a conventional, U-shaped gutter.

As is also illustrated in FIGS. 1, 3 and 4, the lower section of the gutter trap assemblage of the invention, identified by reference numeral 21, has a front wall 22; a rear wall 23 spaced from the front wall 22; opposed, spaced apart end walls 24 and 25; and, a bottom wall 26 interconnecting the front and rear walls 22 and 23 and the opposed end walls 24 and 25 to collectively define an open top 27, the open top 27 being co-extensive with the open bottom 20 of the upper section 14. Thus, upper section 14 communicates with lower section 21 through the common, co-extensive open bottom 20 of upper section 14 and the defined open top 27 of lower section 21. When the gutter trap assemblage of the invention is properly installed, the open bottom 20 of upper section 14 and the defined open top 27 of lower section 21 are on the same plane as the bottom wall 12 of the conventional, U-shaped gutter.

Figure 2:
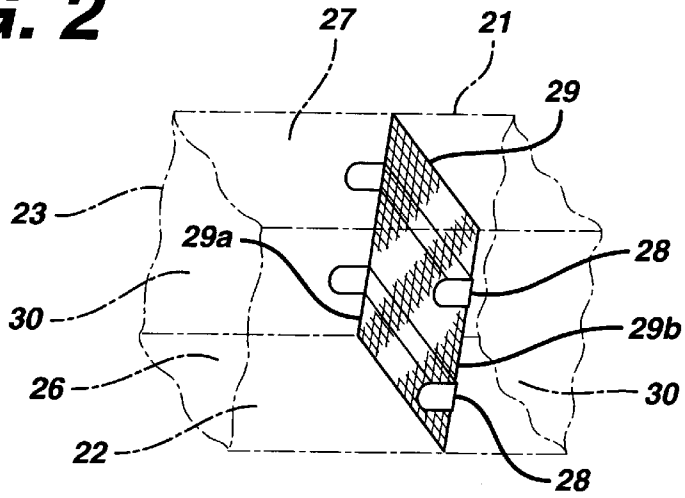
FIG. 2 is a perspective view, part shown in phantom for clarity, illustrating one means by which the screens of the assemblage can be removably secured within the lower section.

As shown in FIG. 2, lower section 21 of the gutter trap assemblage is provided with a plurality of pairs of transverse, horizontally disposed support bars 28 which are secured by conventional means to front and rear walls 22 and 23 within lower section 21 in vertical alignment with one another. These pairs of support bars 28 are spaced apart along the length of lower section 21 and not only impart rigidity and strength to the lower section 21, but also serve to support vertically disposed screen members 29. Screen members 29 are positioned to be on the up-stream side of and in contact with support bars 28. The screen members can be secured in this position by sizing them so that their side edges 29*a*, 29*b*, frictionally engage front and rear walls 22 and 23 enabling them to be slidably removed and re-inserted. When thus secured, screen members 29 define a plurality of chambers 30 (FIGS. 1 and 3–6) along the length of lower section 21. Screen members 29 are also sized to extend vertically from bottom wall 26 to slightly below the plane defined by the open top 27 of lower section 21, the open bottom 20 of upper section 14 and the bottom wall 12 of the conventional, U-shaped gutter.

A removable, tubular gutter downspout screen 31 is provided to extend from a plane at least even with the upper edges of front and rear walls 15 and 16 of upper section 14 through a mating aperture 31*a* formed in bottom wall 26 of lower section 21 to and into the upper end 32*a* of conventional gutter downspout 32 (FIGS. 1 and 3–6). The gutter downspout screen 31 can be held in place by conventional support means.

The gutter trap assemblage is normally secured adjacent the eaves of a roof and is pitched so that rain water or water resulting from melted snow or ice runs off the eaves into the conventional, U-shaped gutter and the gutter trap assemblage and is directed toward the gutter downspout 32. The gutter trap assemblage can be held secured in position by any suitable means such as a plurality of circumferential straps 33 which encircle both the upper section 14 and the lower section 21 as illustrated in FIGS. 1, 3 and 4.

Water flowing in a conventional, U-shaped gutter is discharged from the upper section 14 through its open bottom 20 to lower section 21 through its defined open top 27 thence sequentially through chambers 30 and screens 29 and then through the tubular gutter downspout screen 31 through aperture 31*a* which communicates with gutter downspout 32 at its upper end 32*a*.

Figure 5:
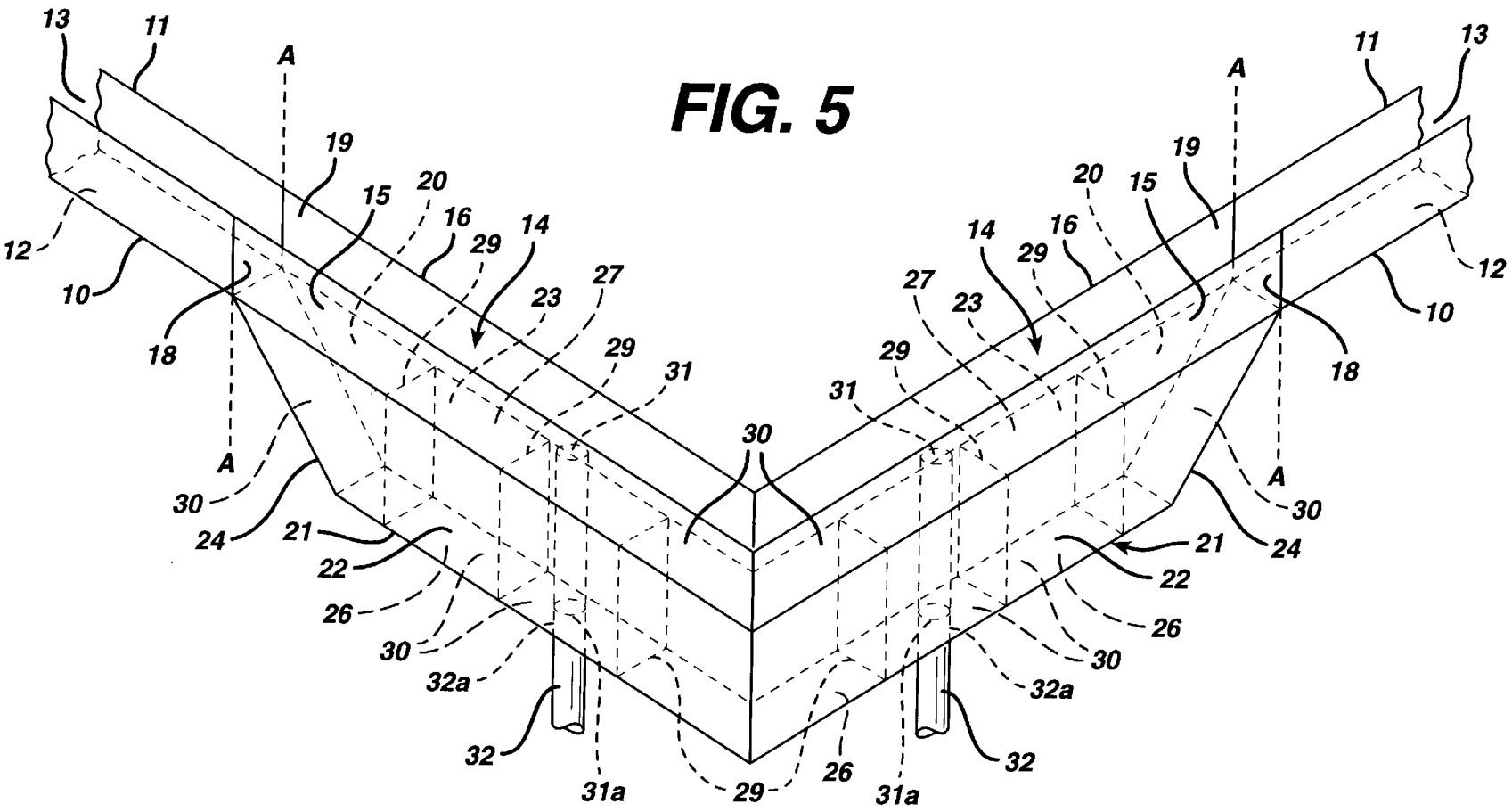
FIG. 5 is a perspective view illustrating another embodiment of the gutter trap assemblage of the invention; and, FIG. 6 is a perspective view illustrating a further embodiment of the gutter trap assemblage of the invention.
Figure 6:
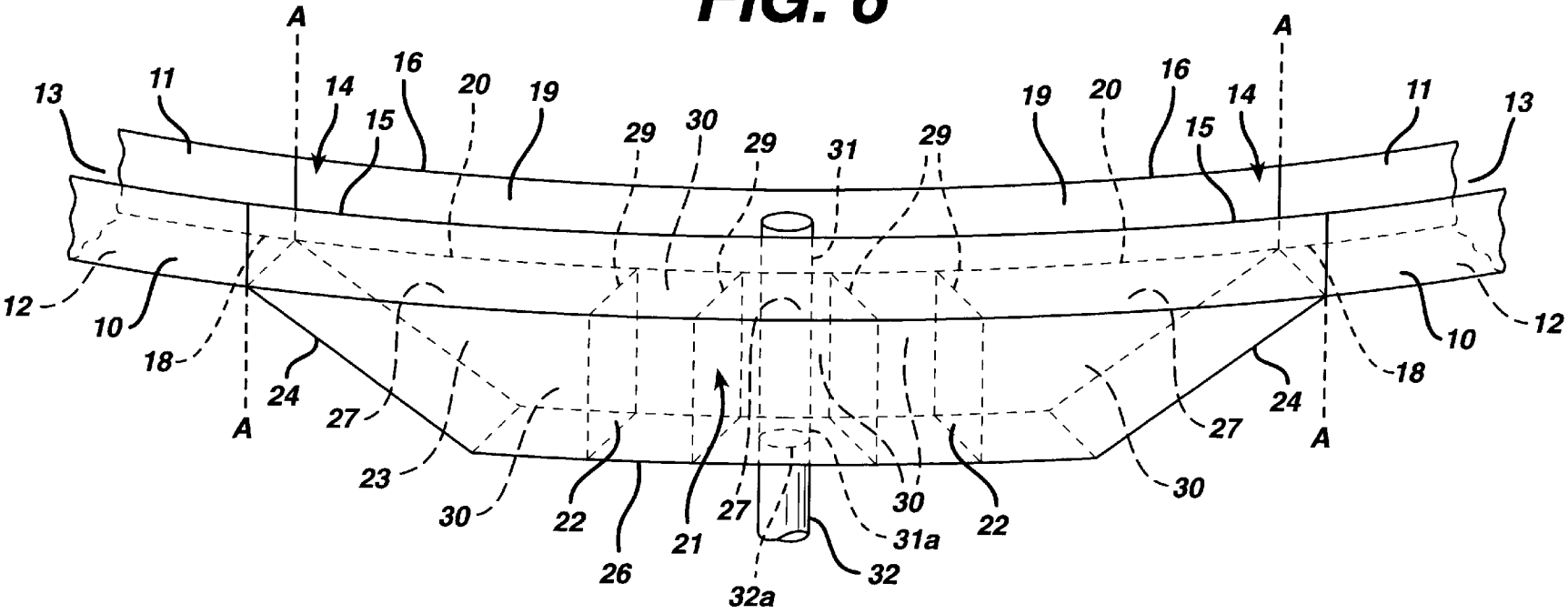

FIG. 5 illustrates the use of the gutter trap assemblage of the invention with a conventional, U-shaped gutter typically provided for use with hip, mansard or pyramidal hip roofs while FIG. 6 illustrates the use of the gutter trap assemblage of the invention with a conventional, U-shaped gutter typically provided for use with circular roofs such as conical hip roofs. In each of these embodiments, both end walls 24 of lower section 21 are angled and the opposed sides 18 of upper section 14 are open ended to mate with and communicate with the conventional, U-shaped gutter when the gutter trap assemblage is installed.

In the foregoing description, the terms "upper section" and "lower section" have been used to simplify and clarify the detailed description of the gutter trap assemblage of the invention. However, from the foregoing description, it is apparent and should be appreciated that the upper and lower sections of the assemblage are an integral, one-piece unit so that the front and rear walls 15 and 16 of the upper section 14 are common with the front and rear walls 22 and 23 of the lower section 21 and the opposed end walls 24 and 25 are extensions of the bottom wall 26 of the lower section 21.

Regardless of the roof style for which a conventional, U-shaped gutter is provided, the size of the gutter trap assemblage of the invention should be sufficient to accommodate a potential volume of anticipated accumulation of seeds, leaves and other debris. This, in turn, will be somewhat dependent upon the type and number of nearby surrounding trees. In determining the dimensions of the gutter trap assemblage, one should bear in mind its proportions for aesthetic appearances. In general, the overall length of the gutter trap assemblage should preferably be no longer than about 6 feet (the arm span of an average man). This will insure that a ladder will need to be positioned only once to clean out the gutter trap assemblage. The width of the gutter trap assemblage should preferably be generally the same as that of the conventional, U-shaped gutter to assure that it mates properly with the gutter trap assemblage of the invention.

Similarly, the type and number of nearby surrounding trees will also dictate the mesh size of the screen members 29 and the tubular gutter downspout screen 31. While not critical, it has been found that a mesh size for these screen members of about ½" will be sufficient for most conditions.

In use, water, seeds, leaves and other debris will typically flow through and be moved along in the conventional, U-shaped gutter until they are deposited in the first chamber in the lower section of the gutter trap assemblage of the invention where they will be trapped by the first chamber screen. The flow of water, however, will continue without interruption through the remaining chambers of the lower section and be discharged through the tubular gutter downspout screen into the gutter downspout.

When the first chamber of the lower section becomes filled or can not accomodate any more seeds, leaves or other debris, additional accumulations will result in their spilling over or cascading from the first chamber into the second chamber. This spilling over, or cascading, will continue for each succeeding chamber until all of the chambers have become filled with seeds, leaves and debris. This spilling over or cascading effect results from the normal pitch of the conventional, U-shaped gutter and the gutter trap assemblage and is also due to the fact that the heights of the chamber screens are slightly below the common plane defined by the bottom wall of the conventional, U-shaped gutter, the open bottom of the upper section, and the defined open top of the lower section of the gutter trap assemblage. Consequently, the water level in the gutter trap assemblage will be either below or at the same level as the water in the bottom of the conventional, U-shaped gutter. Since water seeks its own level, the flow of water will be maintained through the tubular gutter downspout screen and into the gutter downspout. When the chamber containing the tubular gutter downspout screen has become filled, the gutter trap assemblage of the invention should be cleaned of accumulated seeds, leaves and debris.

However, even if the gutter trap assemblage has not been cleaned out after being filled with seeds, leaves and other debris and the seeds, leaves and other debris have backed up into and along the conventional,. U-shaped gutter, only the gutter trap assemblage will have to be cleaned out. It will not be necessary to clean out the entire length of the conventional, U-shaped gutter because it will start to clean itself with the next and succeeding rainfalls. In that part of the conventional, U-shaped gutter containing an accumulation of seeds, leaves and other debris, the accumulation will restrict the flow of water creating a saturation and build up of water in this area. Due to the normal pitch of the conventional, U-shaped gutter and the gutter trap assemblage toward the gutter downspout, these seeds, leaves and other debris will eventually break away in segments or be washed away at their edges by the flow of water. Thus, these seeds, leaves and other debris will continue to be eroded and be deposited into the gutter trap assemblage since there will be no decrease in the flow of water through the tubular gutter downspout screen into the gutter downspout.

One way to quickly and easily clean out the gutter trap assemblage is to first: remove the seeds, leaves and other debris from each side of the chamber screens and from the tubular gutter downspout screen and then remove these screens; second: clean out the remaining seeds, leaves and other debris from the lower section; third: wash and flush out the lower section, the chamber screens and the tubular gutter downspout screen; and, fourth: replace the chamber screens and the tubular gutter downspout screen.

Since only the gutter trap assemblage has to be cleaned and not the entire length of the conventional, U-shaped gutter, multiple trips up and down a ladder for each cleaning along the entire length of a conventional, U-shaped gutter are eliminated. By simplifying the cleaning procedure, safety is increased, the gutters will perform the way they were designed to perform, and the gutter cleaning operation is simplified and enhanced with the gutter trap assemblage of the invention.

Although the gutter trap assemblage of the invention has been described with particularity and in some detail, it will be appreciated by those skilled in this art that modifications and changes can be made therein without departing from the scope and spirit of the invention defined in the ensuing claims.

What is claimed:

1. A unitary, integral gutter trap assemblage for use with conventional, U-shaped gutters and their downspouts comprising;

(a) an upper section having a front wall; a rear wall spaced from said front wall; opposed spaced apart sides; and, an open top and an open bottom defined between said front and rear walls and said opposed, spaced apart sides;

(b) a lower section having a front wall; a rear wall spaced from said front wall; opposed, spaced apart end walls; a bottom wall interconnecting said front wall, said rear wall and said end walls collectively defining an open top therebetween, said defined open top being co-extensive with said open bottom of said section enabling communication between said upper section and said lower section through said open bottom of said upper section and said defined open top of said lower section, said lower section having an aperture formed therein positioned to mate with a conventional downspout, (c) a plurality of transverse, vertically disposed and spaced apart screen members removably secured within said lower section defining a plurality of chambers therein, wherein the upper end of said screen members extend to slightly below said defined open top of said lower section, said open bottom of said upper section, and the bottom wall of said conventional, U-shaped gutter;

(d) a tubular gutter downspout screen positioned in said aperture of said lower section enabling communication with said upper section and a conventional downspout through said lower section; and, (e) means to secure said assemblage to a conventional gutter such that said assemblage communicates with said conventional gutter through said sides of said upper section and such that water, seeds, leaves and other debris will flow through said conventional gutter enabling said seeds, leaves and other debris to be deposited in said lower section while permitting water to continue to flow and be discharged through said downspout screen into said gutter downspout.

2. The gutter trap assemblage of claim 1 wherein the upper end of said tubular gutter downspout screen is on a plane at least even with the upper edges of the front and rear walls of said upper section.

3.The gutter trap assemblage of claim 1 wherein each of the sides of said upper section is open ended.

4. The gutter trap assemblage of claim 1 wherein one side of said upper section is closed and the opposite side is open ended.

* * * * *